US005544882A

United States Patent [19]

Sarkar

[11] Patent Number: 5,544,882

[45] Date of Patent: Aug. 13, 1996

[54] PUZZLE INCLUDING OVERLAYING PUZZLE PIECES

[76] Inventor: Jyotirmoy Sarkar, 5613 N. Woodside Dr., Indianapolis, Ind. 46208

[21] Appl. No.: 436,565

[22] Filed: May 8, 1995

[51] Int. Cl.[6] ..... A63F 9/12

[52] U.S. Cl. ..... 273/157 R; 273/160

[58] Field of Search ..... 273/153 R, 156, 273/157 R, 157 A, 160

[56] References Cited

U.S. PATENT DOCUMENTS

| | | | |
|---|---|---|---|
| 257,630 | 5/1882 | Whitney | 273/157 X |
| 1,290,761 | 1/1919 | Lester . | |
| 2,900,190 | 8/1959 | Pestieau . | |
| 3,608,906 | 9/1971 | Odler | 273/157 R |
| 3,638,949 | 2/1972 | Thompson | 273/157 R |
| 3,788,645 | 1/1974 | Nelson | 273/156 |
| 3,811,203 | 5/1974 | Mayfield | 35/22 R |
| 3,851,884 | 12/1974 | Myller | 273/157 R |
| 4,005,868 | 2/1977 | Hein | 273/156 |
| 4,009,882 | 3/1977 | Rader | 273/135 D |
| 4,037,846 | 7/1977 | Zeeman | 273/157 R |
| 4,153,254 | 5/1979 | Marc | 273/160 |
| 4,323,244 | 4/1982 | Busing | 273/155 |
| 4,428,732 | 1/1984 | Meyer | 434/160 |
| 4,534,563 | 8/1985 | Guenther | 273/157 R |
| 4,699,602 | 10/1987 | Giorgi | 446/124 |
| 4,717,342 | 1/1988 | Hidvegi | 434/96 |
| 4,844,466 | 7/1989 | Johnson et al. | 273/157 R |
| 5,351,957 | 10/1994 | Scott | 273/157 R |

FOREIGN PATENT DOCUMENTS

| | | | |
|---|---|---|---|
| 2512350 | 9/1981 | France . | |
| 3500840 | 1/1985 | Germany . | |
| 521465 | 3/1955 | Italy | 434/167 |
| 484259 | 8/1936 | United Kingdom . | |

*Primary Examiner*—Steven B. Wong
*Attorney, Agent, or Firm*—Baker & Daniels

[57] ABSTRACT

A puzzle including multiple puzzle pieces, each including a two-dimensional outline forming a surface covering area, that are arrangeable to cover a puzzle base. One set of puzzle pieces includes fourteen total pieces with eleven of the pieces having distinct outlines corresponding to the eleven different ways the six faces of a unit cube can be unfolded while remaining connected together and then flattened. The two-dimensional outlines of the other three pieces can be arranged to form the outlines of the eleven puzzle pieces and can be arranged to form a unit cube. In some embodiments, the puzzle bases have exterior peripheries that are three-dimensional and which can be partially or fully covered by the puzzle pieces as a puzzle solution. In other embodiments, the puzzle bases indicate a two-dimensional pattern which the puzzle pieces can be arranged to cover as a puzzle solution.

13 Claims, 5 Drawing Sheets

PUZZLE INCLUDING OVERLAYING PUZZLE PIECES

BACKGROUND OF THE INVENTION

The present invention pertains to a puzzle or game which involves arranging multiple puzzle pieces to reach a puzzle solution.

Puzzles or games of various shapes and sizes that involve a user arranging and rearranging puzzle pieces to achieve a specified solution are well known in the art. Many puzzles, including many jigsaw puzzles, have two-dimensional puzzle solutions. Such puzzles include for example the widely recognized Chinese puzzle known as the tangram that involves combining seven, geometric puzzle pieces into a larger, square shaped puzzle solution. Other puzzles, including some jigsaw type puzzles, involve combining three-dimensional puzzle pieces into a three-dimensional structure. All of these puzzles are usually played with by a user as a source of an enjoyable challenge or entertainment. These puzzles also serve to improve the cognitive abilities of many users, especially children, and can therefore be a valuable educational aid or learning tool.

One limitation of many puzzles, such as those disclosed in U.S. Pat. Nos. 1,290,761, 2,900,190, and 3,811,203, is that the puzzle pieces are intended to be assembled into a puzzle solution which is primarily two-dimensional in configuration. Consequently, while entertaining and to a certain extent challenging to a user, these puzzles do little to encourage three-dimensional conceptualization.

Another shortcoming of some puzzles is that the individual puzzle pieces are only useful in forming the overall puzzle solution. For example, the seemingly randomly shaped pieces associated with common jigsaw puzzles are of little use except when assembled together to form the puzzle solution which is typically an aesthetically pleasing picture. As the puzzle pieces are not manipulatable as miniature puzzles in and of themselves, the pieces of many puzzles, absent an active imagination by a user, consequently have limited utility.

Thus, it would be desirable to provide a puzzle which in a preferred embodiment both forces the puzzle user to think in three dimensions during the solving of the puzzle as well as provides puzzle pieces which may be considered smaller, individual puzzles for a user to manipulate and enjoy.

SUMMARY OF THE INVENTION

The present invention provides a puzzle which requires a person to cover the exterior surfaces of a three-dimensional structure with a set of puzzle pieces which are selected such that proper coverage of the structure surfaces demands the person overlay the pieces on the structure in a studied manner. The puzzle thereby provides an entertaining game which simultaneously forces a puzzle user to think in three dimensions. The present invention also provides puzzle pieces that can be arranged in a planar configuration to form a desired pattern or manipulated in three-dimensions to form a unit cube.

In one form thereof, the present invention provides a puzzle including at least one puzzle base comprising an exterior periphery. The exterior periphery defines a three-dimensional shape and includes multiple surfaces, and each surface comprises a surface area. The puzzle also includes a plurality of puzzle pieces each including a two-dimensional outline forming a surface covering area. The puzzle pieces are positionable by a puzzle user in covering relationship with the puzzle base surfaces to cover at least a portion of the three-dimensional exterior periphery during puzzle solving. The surface covering area of at least one of the puzzle pieces is less than the surface area of at least one of the puzzle base surfaces.

In another form thereof, the present invention provides a puzzle including at least one puzzle base including an exterior periphery, wherein the exterior periphery is three-dimensional in shape and includes a surface area. The puzzle also includes a plurality of puzzle pieces each including a two-dimensional outline forming a surface covering area. The surface covering area of each of the puzzle pieces is less than the exterior periphery surface area. The two-dimensional outline of at least one of the puzzle pieces corresponds to an outline of the six faces of an unfolded and flattened unit cube. The puzzle is solvable by positioning the plurality of puzzle pieces in covering relationship with the puzzle base to cover at least a portion of the three-dimensional exterior periphery.

In still another form thereof, the present invention provides a puzzle including a set of puzzle pieces each including a two-dimensional outline including a surface covering area. The puzzle pieces are arrangeable by a puzzle user to form a variety of two-dimensional patterns, and the two dimensional outline of each of at least a plurality of the puzzle pieces corresponds to an outline of the six faces of an unfolded and flattened unit cube. The plurality of puzzle pieces comprises a first puzzle piece and a second puzzle piece, and the two-dimensional outline of the first puzzle piece differs from the two-dimensional outline of the second puzzle piece. The first and second puzzle pieces each comprise a flexible construction whereby the first and second puzzle pieces can independently be folded into a unit cube configuration by the puzzle user.

One advantage of the puzzle of the present invention is that a common set of puzzle pieces can be used to cover the peripheries of an assortment of three-dimensional base pieces such that multiple challenges can be offered to the user.

Another advantage of the puzzle of the present invention is that the individual puzzle pieces may themselves be manipulated to form a known geometric structure.

Another advantage of the puzzle of the present invention is that a variety of puzzle bases, such as variously shaped polyhedrons, can be utilized.

Still another advantage of the present invention is that the multiplicity of solutions to each puzzle will provide a puzzle of extended life and utility.

Still another advantage of the present invention is that pieces of the puzzle are formed in the various possible shapes of an unfolded unit cube.

BRIEF DESCRIPTION OF THE DRAWINGS

The above mentioned and other advantages and objects of this invention, and the manner of attaining them, will become more apparent and the invention itself will be better understood by reference to the following description of embodiments of the invention taken in conjunction with the accompanying drawings, wherein.

Figure 1:
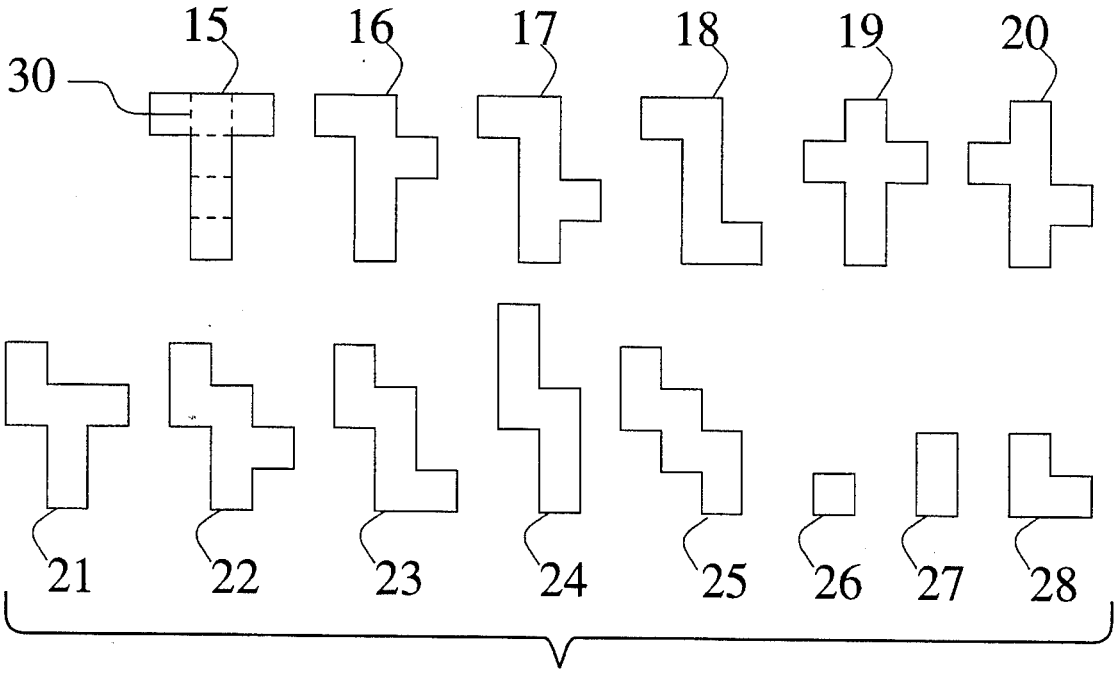
FIG. 1 is a plan view of a preferred set of puzzle pieces, each shown arranged in a planar condition, that may be used to cover periphery portions of an assortment of puzzle bases.

Corresponding reference characters indicate corresponding parts throughout the several views. Although the drawings represent embodiments of the invention, the drawings are not necessarily to scale and certain features may be exaggerated in order to better illustrate and explain the present invention.

DESCRIPTION OF THE PREFERRED EMBODIMENTS

In one of its most basic forms, the puzzle or game of the present invention requires a user to exercise mental faculties to arrange variously shaped puzzle pieces in overlaying fashion on the exterior surfaces of a three-dimensional puzzle base to achieve a degree of base surface coverage which may be specified as a puzzle solution by the manufacturer. Due to the distinctive shapes of the puzzle pieces, the puzzle user will likely not be able to achieve the puzzle solution by haphazard placement of the puzzle pieces on the puzzle base. However, unlike jigsaw puzzles, more than one puzzle piece of the present puzzle may be suitable for placement in any particular position. Therefore, the user will be forced to use good judgment to interfit the pieces together during solving of the puzzle and may have to reconsider earlier placement or placements of the pieces in view of the later possible placements. Consequently, the puzzle of the present invention provides a worthwhile activity which is both intellectually stimulating and entertaining.

Referring now to FIG. 1, there is shown a top view of a preferred set of puzzle pieces each arranged in a planar condition. This puzzle piece set includes fourteen pieces referenced as 15, 16, 17, 18, 19, 20, 21, 22, 23, 24, 25, 26, 27 and 28. Each of puzzle pieces 15–28 is constructed from an essentially flat material and includes a two-dimensional outline as shown that is used to overlay or cover a portion of a puzzle base. Substantially flat materials or pieces are preferred as the flat surface on either side of the pieces allows the pieces to be placed flush with a planar puzzle base surface as described below. To facilitate explanation herein, even though in some embodiments the puzzle pieces during solving of the puzzles can be folded over such that portions may be perpendicular or otherwise angled to the plane in which they are shown in FIG. 1, the shown surfaces of the puzzle pieces in FIG. 1 are considered their respective top surfaces. The bottom surfaces are mirror images of the top surfaces.

The top surfaces of puzzle pieces 15–28 may be the same color as the bottom surfaces. Alternatively, the top surfaces may be made a different color or covered with a different colored paper than the bottom surfaces. The puzzle solution could then require that a specific color face outward when the puzzle base is covered, which would make the puzzle more challenging as a user could not simplify the solving of the puzzle by flipping selected pieces over in order to more easily fit them within particular spaces.

The two-dimensional outline of each of puzzle pieces 15–28 is formed of one or more square units interconnected along adjacent edges. More particularly, puzzle pieces 15–25 are each a two-dimensional representation of the faces or surfaces of a unit cube, or in other words a representation of the relationship the six faces of the cube would have if the cube were unfolded along selected edges while keeping all the faces connected and then flattened. As there are eleven different ways, not counting rotation and reflection symmetry, to unfold the six square faces of a unit cube into a planar shape while keeping the faces connected, eleven different or distinct two-dimensional shapes are possible. Puzzle pieces 15–25 conform to these eleven distinct shapes and can be utilized during puzzle solving to cover differently shaped areas. While rotation and reflection symmetry results in the existence of additional shapes which appear different from the puzzle piece shapes shown in top view but which nonetheless appear to be unfolded unit cubes, it will be appreciated that the eleven planar shapes shown can be rotated and/or flipped over to create these additional shapes.

Puzzle piece 26 is a unit square, or a single face of a unit cube. Puzzle piece 27 is formed of two unit squares connected along an edge, and puzzle piece 28 is formed of three unit squares connected along edges in an 'L' shape. Puzzle pieces 26–28 can be positioned in adjoining relationship to form each of puzzle pieces 15–25 as well as be folded and arranged together to form another or twelfth unit cube.

In order to be employed with multiple puzzle bases, the puzzle pieces are preferably provided with sufficient adaptability or flexibility to conform to the contours of these different puzzle bases. For example, as will become apparent from the following explanation of the manner in which the same puzzle pieces can be arranged for coverage of different puzzle bases to thereby solve these separate puzzles, some portion of the individual puzzle pieces may for different puzzles be required to cover a different surface or surfaces than the remainder of the puzzle piece.

This flexibility can be achieved in a number of ways within the scope of the invention. For example, puzzle pieces 15–28 may be cut or stamped from thin pieces of cardboard and provided with fold lines along the edges of the intersecting unit cube faces along which a user can fold the cube faces during use. These fold lines are illustrated for puzzle piece 15 in FIG. 1 and represented by the dashed lines indicated at 30, but naturally could be provided for all the puzzle pieces. Alternatively, puzzle pieces 15–28 could be made in the shown shapes from a variety of supple but durable materials, such as cloth or a pliable rubber. Such a construction allows the pieces to bend in either direction along any desired line, which is desirable for use with some puzzle bases as described below. Due to their shape and flexibility, puzzle pieces 15–25 can themselves readily be folded by a user into a unit cube.

To assist a user in maintaining puzzle pieces 15–28 in a selected, overlaying relationship with the exterior surfaces of the puzzle bases during puzzle usage, the puzzle pieces and/or bases are preferably provided with a mechanism for the releasable or non-permanent attachment of the pieces to the puzzle bases. For example, adhesives which hold the puzzle pieces in place but which do not prevent removal of the pieces adhesively attached to the base may be employed. Mechanical fasteners such as pins may be employed to tack puzzle pieces 15–28 to the puzzle bases. Alternatively, the top and/or bottom surfaces of the puzzle pieces and the surfaces of the puzzle bases can be cooperatively constructed to maintain in place the puzzle pieces arranged by a user. For example, the puzzle piece surfaces and the puzzle base may be provided with complementary Velcro™ hooks and loops. Alternatively, the top and bottom surfaces may be provided with magnets and the puzzle base surfaces would be metal. To provide these magnets while still allowing the puzzle pieces to easily bend in either direction along the edges of the unit squares, a magnetic rubber material may be cut into a sufficient number of unit squares and glued to both the top and bottom surfaces of the puzzle pieces, which may be made of cloth. It will be appreciated that twelve such magnet squares would preferably be used with each of puzzle pieces 15–25.

The shapes of the described puzzle pieces and their number are preferred but are not intended to limit the scope of the present invention. Different sets of puzzle pieces may be provided and used to cover the exterior surfaces of the below described bases as well as alternate bases.

Figure 2:
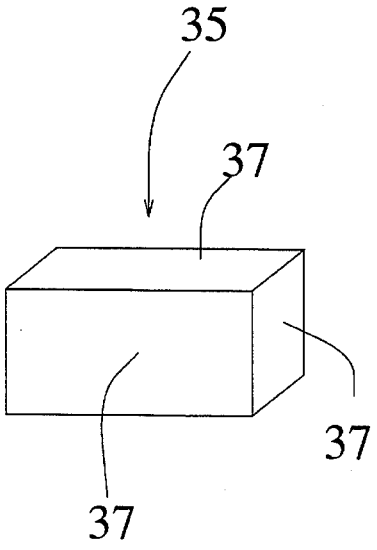
FIG. 2 is a perspective view of a single parallelepiped block dimensioned to serve as a sole puzzle base on which the puzzle pieces of FIG. 1 may be arranged as a puzzle solution.

Referring now to FIG. 2, there is shown a perspective view of a first puzzle base, generally designated 35, which may be used with puzzle pieces 15–28. Puzzle base 35 is a polyhedron block, and in this case a rectangular hexahedron or parallelepiped. Base 35 may be made from any of a variety of materials, such as metal, wood or plastic, and while preferably solid for rigidity the block can be hollow in design. The exterior periphery of puzzle base 35 is formed by six, orthogonally arranged, planar exterior surfaces 37. Base 35 is a 2×3×6 block, wherein the actual depth, height, and width dimensions are respectively 2,3 and 6 times the length of an edge of the individual squares forming the puzzle pieces. The total area of the six exterior surfaces 37 is therefore seventy-two square units.

It will be appreciated that the total surface area which may be covered by puzzle pieces 15–28 is also seventy-two square units. In order for puzzle pieces 15–28 to be overlaid on base 35 to completely cover the area of surfaces 37, the puzzle pieces 15–28 must be strategically positioned by a user on surfaces 37 with no overlap of the puzzle pieces. Consequently, a puzzle solution which can be specified to a user of puzzle pieces 15–28 and puzzle base 35 is that all the surface area of puzzle base surfaces 37 is to be covered by overlaying the puzzle pieces over these surfaces and without destroying any piece.

Figure 3:
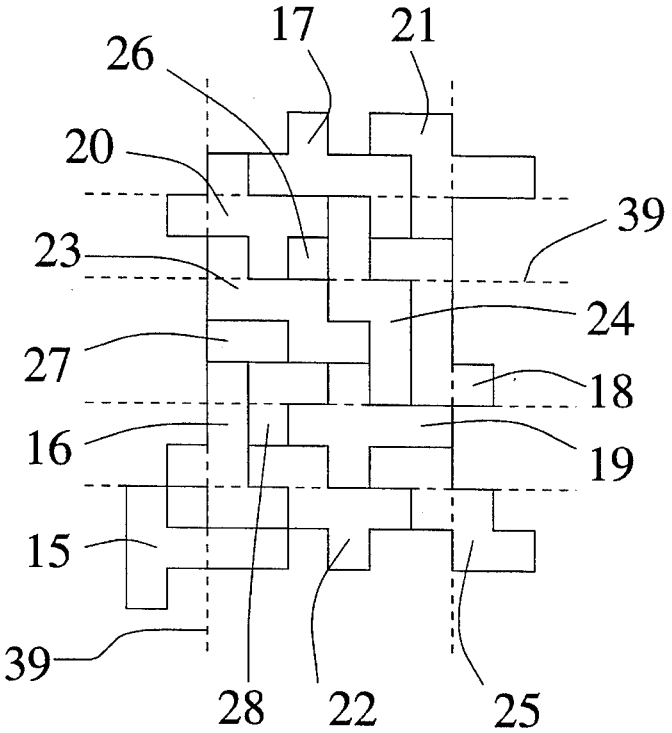
FIG. 3 is a two-dimensional representation of an arrangement of the puzzle pieces of FIG. 1 that is a puzzle solution for the block of FIG. 2.
Figure 4:
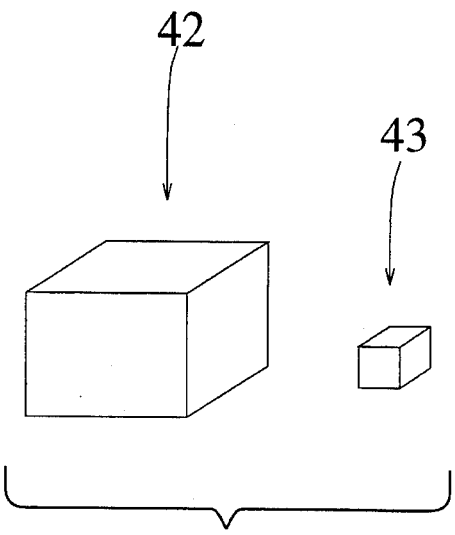
FIG. 4 is a perspective view of a pair of parallelepiped blocks that are used together as puzzle bases on which the puzzle pieces of FIG. 1 may be arranged as a puzzle solution.

FIG. 3 is a two-dimensional representation of one arrangement of the puzzle pieces of FIG. 1 that will achieve this puzzle solution, namely a complete covering of the exterior surfaces 37 of block 35 without puzzle piece overlap. It will be appreciated that the arrangement of puzzle pieces shown in FIG. 3 could conceptually be placed over puzzle base 35 with the dashed lines 39 shown therein aligned with selected edges of base 35.

Figure 5:
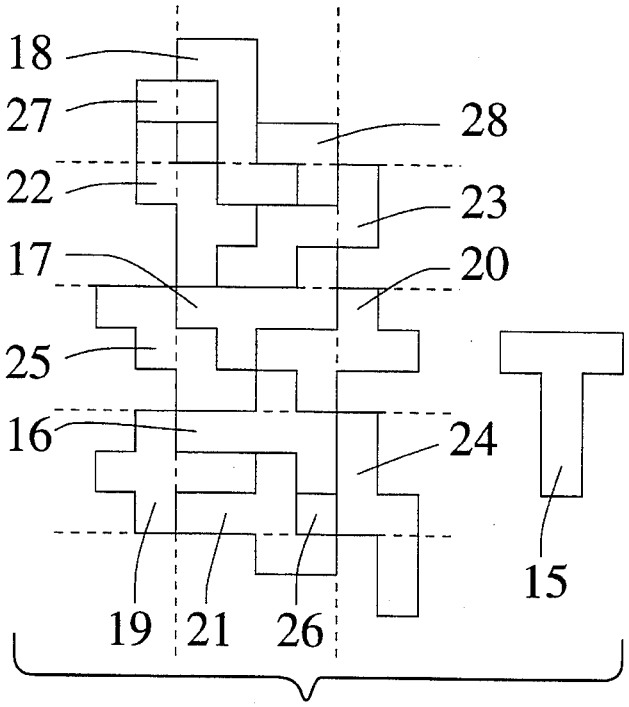
FIG. 5 is a two-dimensional representation of an arrangement of the puzzle pieces of FIG. 1 that is a puzzle solution for the blocks of FIG. 4.

A variety of differently shaped and sized puzzle bases may be substituted for puzzle base 35 within the scope of the invention. For example, a 2×2×8 rectangular block may also have all of its exterior periphery covered by the shown puzzle pieces. Furthermore, similar to the view of FIGS. 2 and 3, FIGS. 4 and 5 disclose another embodiment of a puzzle of the present invention. In this embodiment, a first puzzle base 42 and a second puzzle base 43 are used together. Puzzle base 42 is a 3×3×4 block with an exterior surface area of sixty-six square units and puzzle base 43 is a unit cube, or a 1×1×1 block, with a surface area of six square units. To solve the puzzle, the puzzle pieces 15–28 can be arranged as shown in FIG. 5 to completely cover the surfaces of bases 42, 43 without piece overlap, wherein puzzle piece 15 is wrapped around base 43. It will be appreciated that puzzle base 43 need not be supplied with base 42 in all puzzles or games. For example, if only puzzle base 42 were furnished, the directions for a puzzle player could be that a proper puzzle solution involves completely covering the surfaces of puzzle base 42 without puzzle piece overlap and with only a single puzzle piece left over, which itself could be folded into a cube shape.

Figure 6:
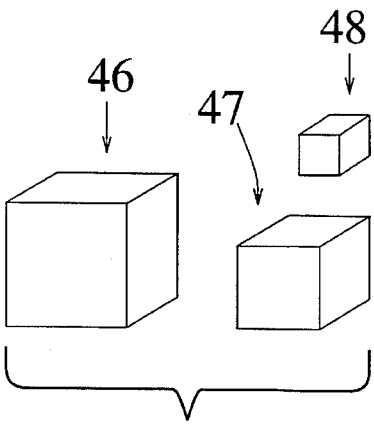
FIG. 6 is a perspective view of three parallelepiped blocks that are used together as puzzle bases on which the puzzle pieces of FIG. 1 may be arranged as a puzzle solution.
Figure 7:
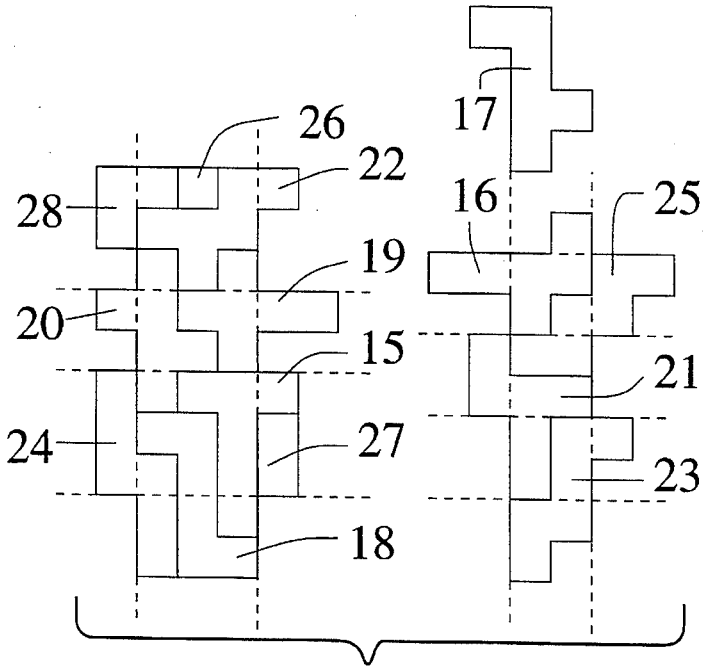
FIG. 7 is a two-dimensional representation of an arrangement of the puzzle pieces of FIG. 1 that is a puzzle solution for the blocks of FIG. 6.

FIGS. 6 and 7 disclose another embodiment of a puzzle of the present invention. In this embodiment, three puzzle bases 46, 47, 48 are used. Puzzle base 46 is a 2×3×3 block, puzzle base 47 is a 2×2×2 block, and puzzle base 48 is a unit cube. A puzzle solution wherein the exterior peripheries of these bases are completely covered by puzzle pieces 15–28 is shown in FIG. 7.

Figure 8:
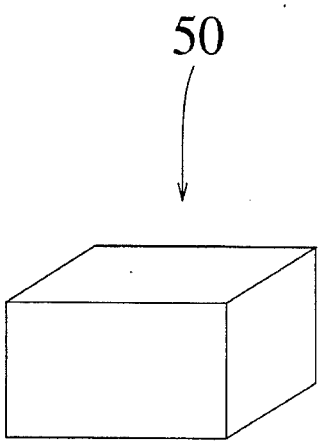
FIG. 8 is a perspective view of a single parallelepiped block that serves as a sole puzzle base on which the puzzle pieces of FIG. 1 may be arranged as a puzzle solution.
Figure 9:
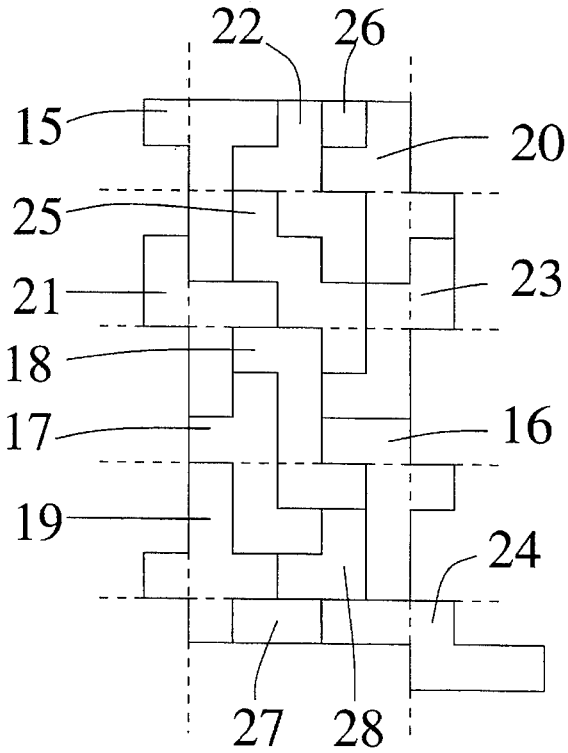
FIG. 9 is a two-dimensional representation of an arrangement of the puzzle pieces of FIG. 1 that is a puzzle solution for the block of FIG. 8.

FIGS. 8 and 9 disclose another embodiment of a puzzle of the present invention. In this embodiment, a single 3×3×5 block is employed as puzzle base 50. As the surface area of the exterior periphery of base 50 equals seventy-eight square units, it will be appreciated that puzzle pieces 15–28 can not completely cover the exterior periphery. Therefore, the directions for a puzzle player could be that a proper puzzle solution involves covering as much of puzzle base 50 without puzzle piece overlap. One such solution is shown in FIG. 9. Alternatively, additional puzzle pieces could be provided for use with puzzle base 50 such that the exterior periphery could be completely overlaid with puzzle pieces.

Figure 10:
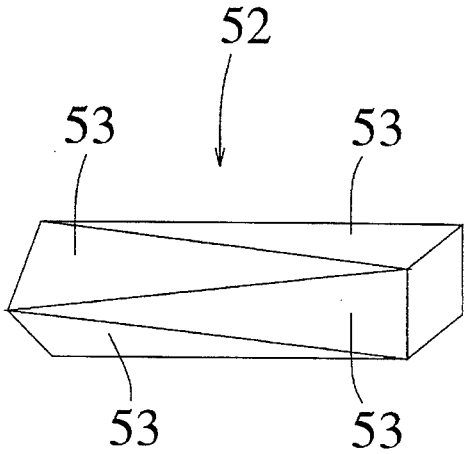
FIG. 10 is a perspective view of a twisted block dimensioned to serve as a sole puzzle base on which the puzzle pieces of FIG. 1 may be arranged as a puzzle solution.
Figure 11:
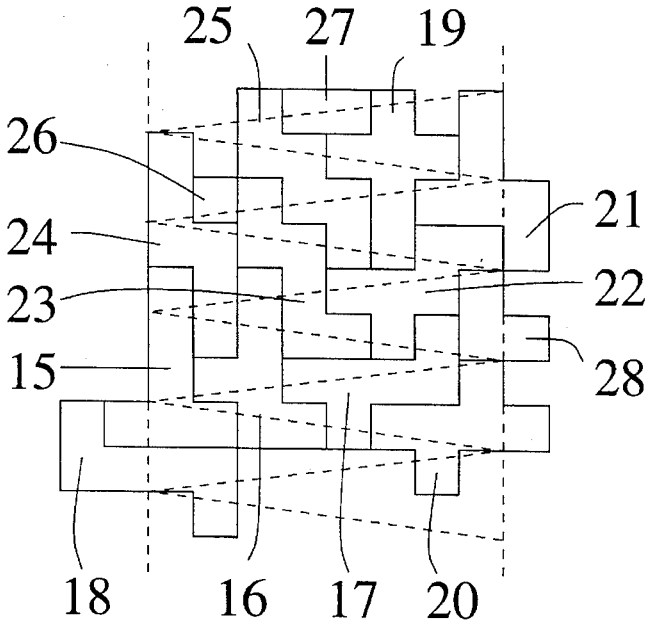
FIG. 11 is a two-dimensional representation of an arrangement of the puzzle pieces of FIG. 1 that is a puzzle solution for the block of FIG. 10.

FIGS. 10 and 11 disclose another embodiment of a puzzle of the present invention. Puzzle base 52 is a twisted block with eight isosceles triangular faces 53. Twisted block 52 can be best conceptualized as the structure resulting from taking a 2×2×8 rectangular parallelepiped, rotating one 2×2 end through an angle of 45° while holding the other 2×2 end fixed, and then replacing the four 2×8 rectangular faces with eight triangular faces 53 each measuring $2\times\sqrt{65}\times\sqrt{65}$ oriented alternately up or down and with their bases matching with an edge of the opposite ends of the block. Twisted block 52 has a surface area of seventy-two square units, and a solution for block 52 wherein the entire exterior periphery is covered by puzzle pieces 15–28 is shown in FIG. 11. It will be appreciated that the puzzle pieces used with twisted block base 52 are preferably the type which are bendable along any line as described above in order for the pieces to conform to the surfaces of the twisted block.

Figure 12:
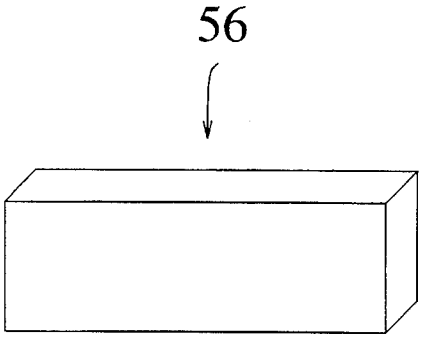
FIG. 12 is a perspective view of a single parallelepiped block that serves as a sole puzzle base on which the puzzle pieces of FIG. 1 may be arranged as a puzzle solution.
Figure 13:
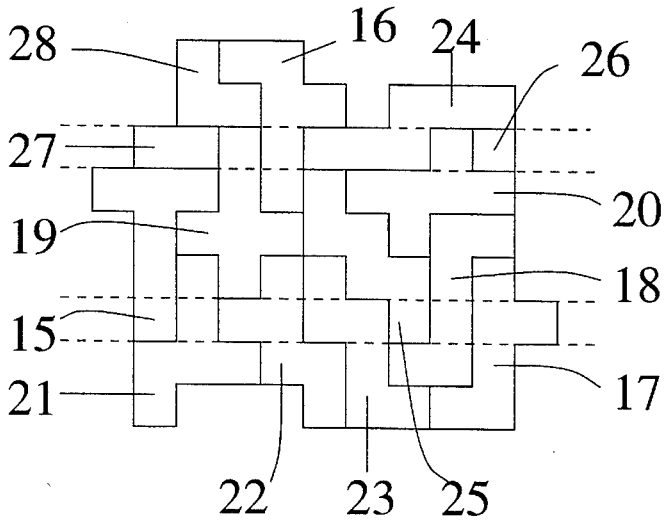
FIG. 13 is a two-dimensional representation of an arrangement of the puzzle pieces of FIG. 1 that is a puzzle solution for the block of FIG. 12.

FIGS. 12 and 13 disclose another embodiment of a puzzle of the present invention. In this embodiment, a single puzzle base 56 in the form of a 1×3×9 block is provided as shown in FIG. 12. A puzzle solution wherein as much of puzzle base 56 is covered with puzzle pieces 15–28 as possible without puzzle piece overlap is shown in FIG. 13.

Figure 14:
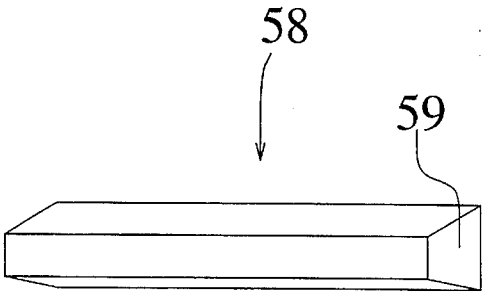
FIG. 14 is a perspective view of a single prism that serves as a sole puzzle base on which the puzzle pieces of FIG. 1 may be arranged as a puzzle solution.
Figure 15:
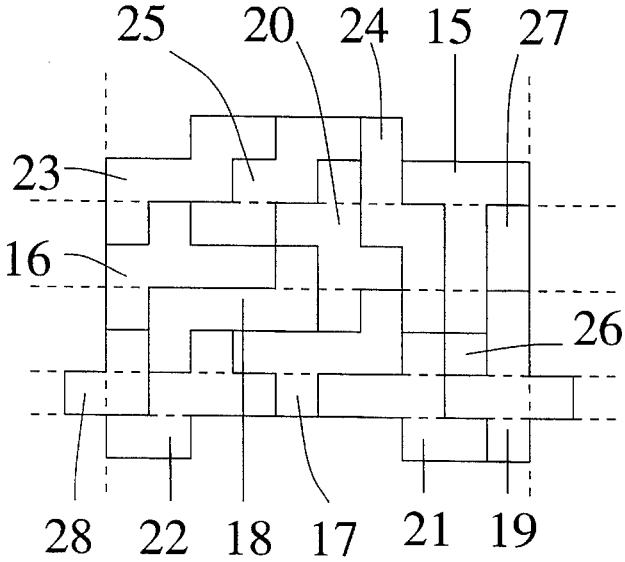
FIG. 15 is a two-dimensional representation of an arrangement of the puzzle pieces of FIG. 1 that is a puzzle solution for the prism of FIG. 14.

FIGS. 14 and 15 disclose another embodiment of a puzzle of the present invention. In this embodiment, puzzle base 58 is a prism which is ten units tall and has quadrilateral bases 59 or ends each measuring 2×2×1×2. A puzzle solution using puzzle pieces 15–28 to cover all the sides of puzzle base 58 and a portion of bases 59 is shown in FIG. 15. Other prisms, such as one which is eight units tall and has a 3×3×3 triangular base, may also be used as puzzle bases.

Figure 16:
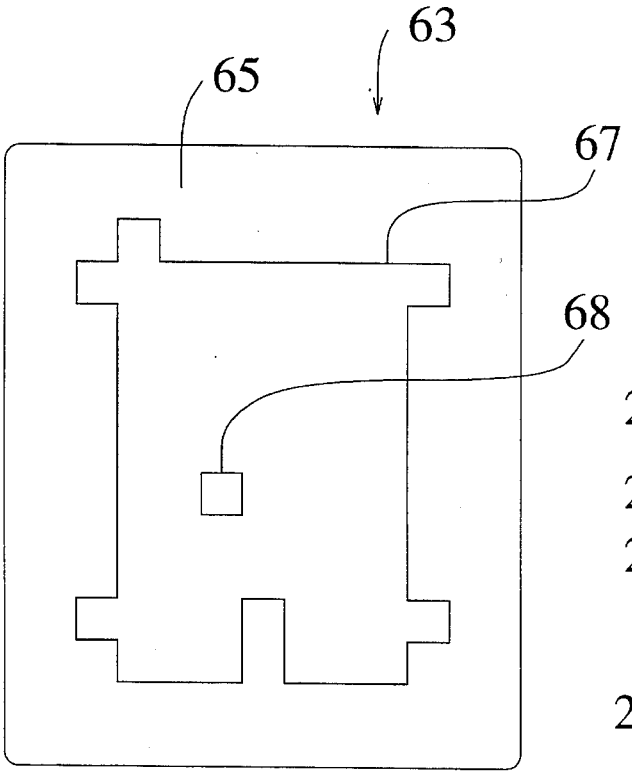
FIG. 16 is a plan view of one puzzle base with which the puzzle pieces of FIG. 1 may be used in a two-dimensional game.

In addition to using a set of puzzle pieces such as puzzle pieces 15–28 in the three dimensional games or puzzles described above, and in addition to folding the pieces into unit cubes, a puzzle user can combine puzzle pieces 15–28, or particular subsets thereof, in a generally planar arrangement to form a variety of familiar patterns. To guide a user's planar arranging of the puzzle pieces, illustrations of the overall shape to be formed with the puzzle pieces may be provided to a user. Alternatively, as shown in FIG. 16, a puzzle base, generally designated 63, may be provided for use with puzzle pieces 15–28. Puzzle base 63 may be made from a flat, rigid board or panel 65. Provided on the face of panel 65 are indicia which instruct the user as to the pattern to be covered during arranging of the puzzle pieces. In this embodiment, the indicia define a building pattern, and the indicia are lines 67, 68 which respectively outline the overall building shape and a region of the building pattern to be left uncovered to represent a window. Other types of indicia are within the scope of the invention. For example, the puzzle solution pattern could be shaded or colored on panel 65. Alternatively, the pattern could be recessed into panel 65, which would thereby serve as a type of template. It will be appreciated that for this template design, the indicia shown at 68 could project from the recess so as to be an island therein.

Figure 17:
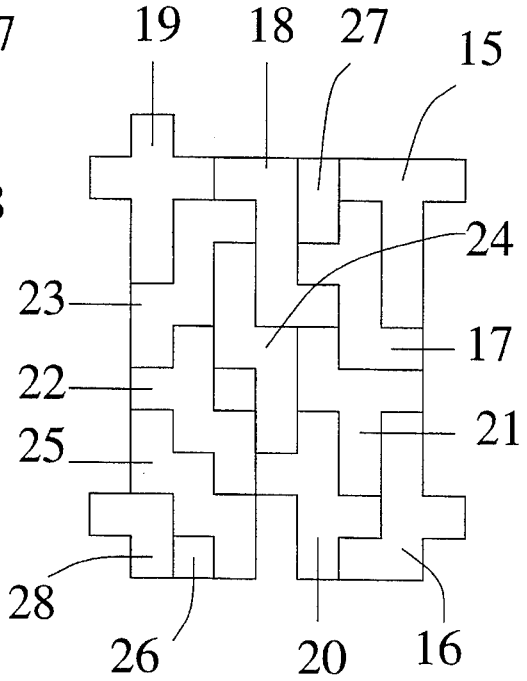
FIG. 17 is an arrangement of the puzzle pieces of FIG. 1 that is a puzzle solution for the puzzle base of FIG. 16.

An arrangement of puzzle pieces 15–28 which fits or covers the pattern of FIG. 16 and therefore solves the puzzle is shown in FIG. 17.

Figure 18:
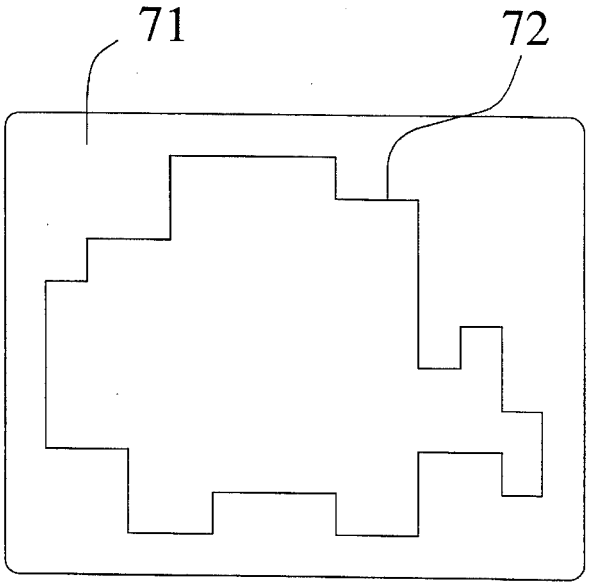
FIG. 18 is a plan view of another puzzle base with which the puzzle pieces of FIG. 1 may be used in a two-dimensional game.
Figure 19:
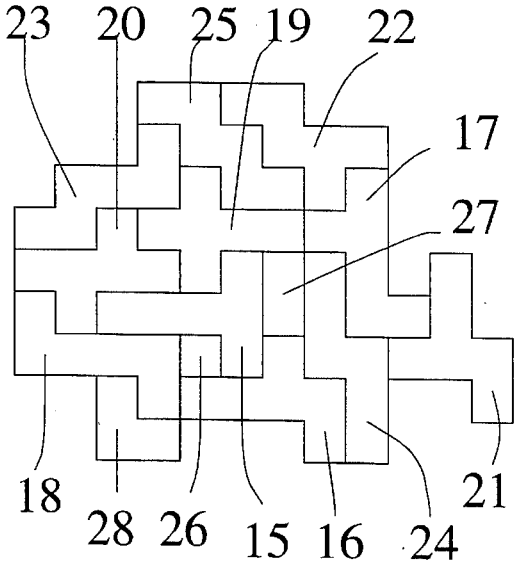
FIG. 19 is an arrangement of the puzzle pieces of FIG. 1 that is a puzzle solution for the base of FIG. 18.

Referring now to FIG. 18 and 19, an additional embodiment of the puzzle of the present invention is shown. Panel 71 is provided with a pattern 72 for an object which users may recognize as a side view of a water cooler. An arrangement of puzzle pieces 15–28 which solves this puzzle is shown in FIG. 19. It will be appreciated that many other two-dimensional puzzles are also possible within the scope of the invention.

While this invention has been described as having multiple designs, the present invention may be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains.

What is claimed is:

1. A puzzle comprising;

at least one puzzle base comprising an exterior periphery, wherein said exterior periphery defines a three-dimensional shape and includes multiple surfaces, each surface comprising a surface area;

a plurality of puzzle pieces each including a two-dimensional outline forming a surface covering area, said plurality of puzzle pieces positionable by a puzzle user in covering relationship with said puzzle base surfaces to cover at least a portion of said three-dimensional exterior periphery during puzzle solving, wherein said surface covering area of at least one of said plurality of puzzle pieces is less than said surface area of at least one of said puzzle base surfaces; and wherein said plurality of puzzle pieces comprises a first puzzle piece and a second puzzle piece, wherein said two-dimensional outline of said first puzzle piece differs from said two-dimensional outline of said second puzzle piece, and wherein said two-dimensional outline of each of said first and second puzzle pieces corresponds to an outline of the six faces of an unfolded and flattened unit cube.

2. The puzzle of claim 1 wherein all of said plurality of puzzle pieces may be used to cover said three-dimensional exterior periphery during puzzle solving without overlap of said puzzle pieces.

3. The puzzle of claim 1 wherein said plurality of puzzle pieces includes a first puzzle piece comprising a flexible construction, whereby said first puzzle piece can adapt to cover portions of at least two puzzle base surfaces during puzzle solving.

4. The puzzle of claim 1 wherein said at least one puzzle base comprises a polyhedron.

5. The puzzle of claim 4 wherein said polyhedron comprises a hexahedron.

6. The puzzle of claim 5 wherein said hexahedron comprises a rectangular parallelepiped.

7. The puzzle of claim 1 wherein said at least one puzzle base comprises a first puzzle base and a second puzzle base.

8. The puzzle of claim 7 wherein said first puzzle base and said second puzzle base comprise different polyhedrons.

9. A puzzle comprising;

at least one puzzle base comprising an exterior periphery, wherein said exterior periphery is three-dimensional in shape and comprises a surface area;

a plurality of puzzle pieces each including a two-dimensional outline forming a surface covering area, said surface covering area of each of said puzzle pieces being less than said exterior periphery surface area, wherein said two-dimensional outline of at least one of said puzzle pieces corresponds to an outline of the six faces of an unfolded and flattened unit cube;

wherein said puzzle is solvable by positioning said plurality of puzzle pieces in covering relationship with said puzzle base to cover at least a portion of said three-dimensional exterior periphery; and wherein said plurality of puzzle pieces includes a first puzzle piece and a second puzzle piece, wherein said two-dimensional outlines of said first and second puzzle pieces are different and each corresponds to an outline of the six faces of an unfolded and flattened unit cube.

10. The puzzle of claim 9 wherein said plurality of puzzle pieces comprises eleven puzzle pieces, and wherein said two-dimensional outlines of said eleven puzzle pieces correspond to eleven different outlines of the six faces of an unfolded and flattened unit cube.

11. The puzzle of claim 10 wherein said plurality of puzzle pieces further comprises a twelfth puzzle piece, a thirteenth puzzle piece, and a fourteenth puzzle piece, and wherein said two-dimensional outlines of said twelfth puzzle piece, said thirteenth puzzle piece, and said fourteenth puzzle piece can be arranged to form said two-dimensional outline of each of said eleven puzzle pieces.

12. A puzzle comprising;

at least one puzzle base comprising an exterior periphery, wherein said exterior periphery defines a three-dimensional shape and includes multiple surfaces, each surface comprising a surface area;

a plurality of puzzle pieces each including a two-dimensional outline forming a surface covering area, said plurality of puzzle pieces positionable by a puzzle user in covering relationship with said puzzle base surfaces to cover at least a portion of said three-dimensional exterior periphery during puzzle solving, wherein said surface covering area of at least one of said plurality of puzzle pieces is less than said surface area of at least one of said puzzle base surfaces; and wherein said plurality of puzzle pieces comprises eleven puzzle pieces, and wherein said two-dimensional outlines of said eleven puzzle pieces correspond to eleven different outlines of the six faces of an unfolded and flattened unit cube.

13. The puzzle of claim 12 wherein said plurality of puzzle pieces further comprises a twelfth puzzle piece, a thirteenth puzzle piece, and a fourteenth puzzle piece, and wherein said two-dimensional outlines of said twelfth puzzle piece, said thirteenth puzzle piece, and said fourteenth puzzle piece can be arranged to form said two-dimensional outline of each of said eleven puzzle pieces.

* * * * *